US008919745B1

(12) United States Patent
Rowe

(10) Patent No.: US 8,919,745 B1
(45) Date of Patent: Dec. 30, 2014

(54) HIGH FLOW RATE FOAM GENERATING APPARATUS

(71) Applicant: Carroll G. Rowe, Washington, AR (US)

(72) Inventor: Carroll G. Rowe, Washington, AR (US)

( * ) Notice: Subject to any disclaimer, the term of this patent is extended or adjusted under 35 U.S.C. 154(b) by 178 days.

(21) Appl. No.: 13/627,851

(22) Filed: Sep. 26, 2012

Related U.S. Application Data

(60) Provisional application No. 61/539,568, filed on Sep. 27, 2011.

(51) Int. Cl.
*A62C 5/02* (2006.01)

(52) U.S. Cl.
CPC ..... *A62C 5/02* (2013.01)
USPC ..... 261/95; 169/5; 261/74; 261/98; 261/116

(58) Field of Classification Search
CPC ..... C02F 3/06; A62C 5/02
USPC ..... 261/74, 76, 98, 166, 95; 169/5
See application file for complete search history.

(56) References Cited

U.S. PATENT DOCUMENTS

| | | | | | |
|---|---|---|---|---|---|
| 172,467 | A | * | 1/1876 | Melcher | 239/559 |
| 2,137,338 | A | | 11/1938 | Gosmann | |
| 2,386,464 | A | * | 10/1945 | Hogenmiller | 261/116 |
| 2,597,913 | A | * | 5/1952 | Webster | 261/116 |
| 2,936,835 | A | | 5/1960 | Sheppard | |
| 3,261,471 | A | * | 7/1966 | Halpert | 210/167.25 |
| 3,361,412 | A | | 1/1968 | Cole, III | |
| 3,749,378 | A | | 7/1973 | Rhodes | |
| 4,163,035 | A | * | 7/1979 | Gorsky | 261/77 |
| 4,330,086 | A | | 5/1982 | Nysted | |
| 4,375,438 | A | * | 3/1983 | McKay | 261/23.2 |
| 4,968,458 | A | * | 11/1990 | Besnia | 261/78.1 |
| 5,382,389 | A | | 1/1995 | Goodine et al. | |
| 5,445,226 | A | * | 8/1995 | Scott et al. | 169/15 |
| 5,900,191 | A | | 5/1999 | Gray et al. | |
| 5,972,212 | A | * | 10/1999 | Hongo | 210/150 |
| 6,602,916 | B2 | | 8/2003 | Grundmann et al. | |

FOREIGN PATENT DOCUMENTS

| | | | |
|---|---|---|---|
| CN | 101381171 | A * | 9/2007 |
| CN | 201168575 | Y * | 12/2008 |

OTHER PUBLICATIONS

CN 201168575 Y as translated by Schreiber Translations, Inc.*

* cited by examiner

*Primary Examiner* — Duane Smith
*Assistant Examiner* — Stephen Hobson

(57) ABSTRACT

A foam generating apparatus provides a high-quality mixing of solution and air to produce foam without restricting the flow of liquid through apparatus. An air manifold has passages allowing the flow of water or solution through the apparatus and also features apertures that introduce pressurized air in a parallel flow with the water or solution introduced into the exit chamber. The cross-sectional area of the passages is at least as great as the water or solution inlet, and thus the device does not significantly restrict flow of liquid, even in the case where a straight flow of water or solution without mixed air is desired.

8 Claims, 1 Drawing Sheet

HIGH FLOW RATE FOAM GENERATING APPARATUS

CROSS-REFERENCE TO RELATED APPLICATIONS

This application claims the benefit of U.S. provisional patent application No. 61/539,568, filed on Sep. 27, 2011, and entitled "High Flow Rate Foam Generating Apparatus." Such application is incorporated by reference herein.

STATEMENT REGARDING FEDERALLY SPONSORED RESEARCH OR DEVELOPMENT

Not applicable.

BACKGROUND OF THE INVENTION

Various compressed air foam systems (CAFS) have been used in firefighting applications. In its most basic form, a CAFS is simply a means for mixing air and water with a surfactant in order to produce a water-based foam that is used to extinguish fires. CAFS provides quicker "knockdown" against potent fires, deeper penetration of fuels, and gives firefighters the advantage of making their initial attack against a fire from a significantly greater distance than with a traditional water stream or fog pattern. The bubble structure allows for greater expansion of delivered water surface area, allowing for greater heat reduction compared to equal amounts of plain water. Foam blankets allow for pre-treatment of fuels that are not already involved in the fire, and have less adverse impact on property, as well as helping to prevent damage to evidence used for fire investigations. In fact, some studies have indicated that CAFS increases the effectiveness of water as an extinguishing agent by approximately a factor of five. CAFS may be particularly valuable for rural fire departments, because the use of foam reduces the amount of water required to extinguish a fire, and rural departments are often quite limited in the amount of water that they have available at any particular fire.

One problem raised by the adoption of OAFS systems is that there may be certain applications where, even though a OAFS system is available, it is desirable to use only water in fighting a particular fire. For example, this may be desired if solution is not immediately available. It would be advantageous if the OAFS system could simply be deactivated in the field without the removal of any equipment, thereby allowing simple water flow. Likewise, it would be advantageous if the OAFS system allowed for the relatively unrestricted flow of solution rather than water, where "solution" is a combination of water and surfactant without the injection of air to produce foam. Solution has been shown to be more effective than simple water in suppressing certain types of fires, and there are firefighting applications where it is deemed more desirable than OAFS. Another advantage would be to allow for the combination of either water or solution flow with OAFS production to produce a "wet OAFS" flow, thereby giving the firefighter a full selection of operating modes that may be utilized in order to best address a particular firefighting scenario arising in the field. It would also be desirable to develop such a system without the need for complex bypass piping, in order to keep the cost of any new apparatus or necessary retrofit on an existing apparatus as low as possible and minimize the on-board space required for the retrofit.

In addition, it would be desirable to develop a OAFS system that could be used to deliver water-only flow at a maximum rate when the OAFS equipment is deactivated, just as if the system would deliver if no OAFS equipment were present, that is, as if the water were simply passing through straight pipe rather than through the OAFS equipment. This would allow for the greatest possible flow rate of water when a large amount of water is available and is desired for effectively suppressing a particular fire.

Finally, it would be desirable to develop a OAFS system that provides the highest possible water/solution flow rate during foam production for a given size of inlet line. In those applications where the amount of water/solution available is not a limiting factor, firefighting capacity can be increased by increasing the quantity of foam that may be delivered to a particular application. Some existing OAFS systems use various devices and features for mixing of the solution and air, which tend to impede the flow of foam to the application. It would be desirable to develop a system that provides a minimum of flow resistance, thereby maximizing foam delivery rates, while still providing a high quality foam through adequate mixing of the solution water and air within the OAFS mixing chamber.

Devices or references mentioned in this background section are not admitted to be prior art with respect to the present invention.

BRIEF SUMMARY OF THE INVENTION

The present invention is directed to a foam generating apparatus that provides for full flow of water for firefighting applications when the foam generating system is deactivated, yet provides foam of a controllable consistency and high flow rate when the foam generating system is activated.

In one aspect, the invention is directed to a foam generating apparatus comprising an entry chamber, an exit chamber, and an air manifold comprising a hollow interior and positioned between the entry and exit chamber, wherein the air manifold comprises a plurality of air apertures configured to direct pressurized air from within the hollow interior into the exit chamber, and wherein the air manifold further comprises a plurality of passages sealed from the hollow interior and configured to allow liquid to pass from the entry chamber to the exit chamber.

These and other features, objects and advantages of the present invention will become better understood from a consideration of the following detailed description of the preferred embodiments and appended claim in conjunction with the drawings as described following:

DETAILED DESCRIPTION OF THE PREFERRED EMBODIMENT(S)

Figure 1:
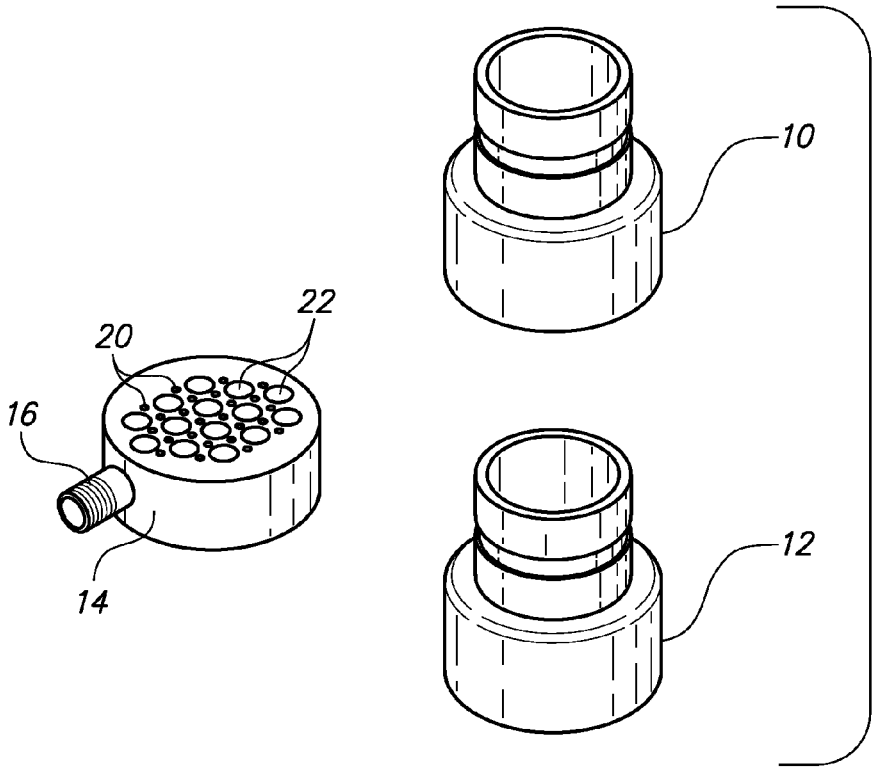
FIG. 1 is an exploded perspective view of a preferred embodiment of the present invention.
Figure 2:
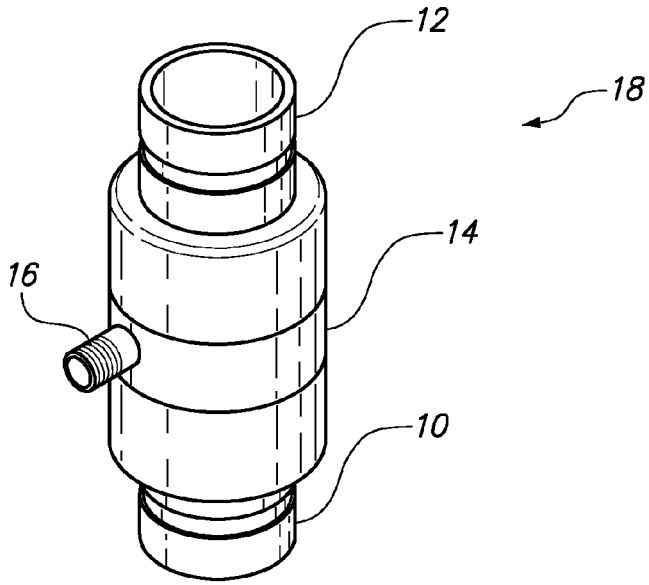
FIG. 2 is an assembled perspective view of a preferred embodiment of the present invention.

With reference to FIGS. 1 and 2, the preferred embodiment of the present invention may now be described. The three main components of an air-solution mixing apparatus 18 of the preferred embodiment are an entry chamber 10, an exit chamber 12, and an air manifold 14. These components, shown separately in FIG. 1, may be assembled together as shown in FIG. 2 for use. The components are preferably welded together for strength and leak-free operation, but may be connected by other means as are well known in the art.

Each of these components is preferably formed of stainless steel for durability and corrosion resistance, but in alternative embodiments these components could be formed of other materials that either in their raw form or with appropriate coatings or paint may be rendered resistant to corrosion due to the passage of water. Such materials include, for example, brass and certain high-strength plastics as are known in the art.

Entry chamber 10 and exit chamber 12 are preferably sized such that their inlet and outlet, respectively, is sized to accommodate the size of piping used in a particular firefighting truck or other delivery apparatus. Common sizes of piping used span from around 1" up to around 6", depending upon the application. The diameter of entry chamber 10 and exit chamber 12 increases at the point where the entry and exit chamber components join with the air manifold, for reasons as will be made clear below. In the preferred embodiment, entry chamber 10 and exit chamber 12 may be identical in shape and size, but in alternative embodiments may be of different shapes and sizes.

Air manifold 14 comprises an air inlet 16, to which a pipe or hose (not shown) may directed pressurized air into air manifold 16. The interior of manifold 16 is hollow, in order to allow for air passage within air manifold 16 during foam production. The air exits entering air inlet 16 and passing through the hollow body of air manifold 16 exits air manifold 16 through the plurality of small air apertures 20 shown in FIG. 1. It should be noted that air apertures 20 only appear on the exit chamber side of air manifold 16; the entry chamber side of air manifold 16 has no air apertures 20. It is through these small openings that the air is introduced into the solution water within the device.

Air manifold 14 also features a plurality of larger solution passages 22 that pass completely through air manifold 14 while being sealed from the hollow interior of air manifold 14. These may be formed, for example, as small pipes that are welded or otherwise attached through air manifold 14 at holes drilled through the entry and exit sides of air manifold 14 to receive them. It may be seen that solution passages 22 are open on both the entry chamber and exit chamber sides of air manifold 14. This allows free passage of solution water or water through solution passages 22 in air manifold 14 from inlet 10 to outlet 14 of the apparatus. Air apertures 20 through which air passes from air manifold 14 are generally positioned adjacent to solution passages 22, such that air enters exit chamber 12 near and around the points at which solution water passes through solution passages 22 from entry chamber 10 into exit chamber 12. Many variations on the geometrical arrangement of air apertures 20 and larger solution passages 22 are within the scope of the present invention, provided that air apertures 20 are positioned adjacent to solution passages 22 for purposes of mixing, as will be explained below. The number and size of solution passages 22 may also vary within the scope of the present invention, but the aggregate cross-sectional area of solution passages 22 is preferably at least equal to the cross-sectional area of the inlet pipe at entry chamber 10. In this way, there is no significant restriction created by the presence of air manifold 14 between entry chamber 10 and exit chamber 12.

The structure of the preferred embodiment of the present invention having been described, the operation of the preferred embodiment during foam production will next be discussed. Solution enters entry chamber 10, and passes through entry chamber 10 and through solution passages 22 in air manifold 14 to reach exit chamber 12. It may be seen that air manifold 14 does not provide any substantial restriction of solution or water flow because, owing to the larger diameter of entry chamber 10 at air manifold 14 as opposed to at its inlet, a sufficient number of solution passages 22 may be provided such that the aggregate cross-sectional area of those solution passages 22 is at least equal to the cross-sectional area of the entry chamber 10 inlet. Thus full flow of solution or water may be maintained through solution passages 22 in air manifold 14 as if the device were replaced with straight pipe, regardless of whether foam is being produced.

While solution water passes through air manifold 14 by means of solution passages 22, air is simultaneously pumped through air manifold inlet 16 into the hollow interior of air manifold 14, and then out of air manifold 14 through air apertures 20. As air exits apertures 20 into exit chamber 12 of the device, it will be seen that it is doing so adjacent to solution chambers 22 where solution water is passing into exit chamber 12, and does so in a series of streams that are parallel to those of the solution water passing into exit chamber 12. It may be noted that, owing to the design of the apparatus, the cross-sectional area of exit chamber 12 adjacent to air manifold 14 is necessarily larger than the aggregate cross-sectional area of solution passages 22 through which water or solution is passing. As a result, the inventor believes that solution or water entering exit chamber 12 will undergo a pressure change as it passes out from solution passages 22 into exit chamber 12. It follows from Bernoulli's principle that there will also be a corresponding change in the velocity of the solution water. In addition, it may be noted that air apertures 20 dispense pressurized air into exit chamber 12 in streams that are parallel to the flow of solution water from solution passages 22. The inventor believes that this pressure/velocity change, coupled with the parallel injection of solution water and air through separate but interspersed streams, is the mechanism that produces a thorough mixing of the solution water and air to result in a high-quality foam. The invention is not, however, limited to this theory of operation.

Once the solution water/air mixture is formed in exit chamber 12, it then passes into the smaller-diameter section of exit chamber 12 at the outlet of exit chamber 12, and then passes out of the device. It is believed that the smaller diameter at the outlet relative to the area of exit chamber 12 nearer the air manifold results in another pressure change, and corresponding change in velocity, of the solution water/air mixture exiting the device. The solution water/air mixture then passes through the piping of the delivery system (not shown), optionally through a length of hose, and then through a nozzle for delivery to the application. If only water delivery is desired, then no air is introduced through air manifold 14, but operation otherwise proceeds as described herein.

Experiments performed by the inventor confirm the successful operation of the preferred embodiment as described herein. The inventor has also confirmed that the foam consistency (i.e., "wet" versus "dry" foam) may be varied by partially opening and closing a valve (not shown) interposed between the pressurized air source and air inlet 16 on air manifold 14, a valve between the solution water source and entry chamber 10, or both such valves. Experiments have also confirmed that full water flow may be generated through the device as if the device were replaced with straight piping when the foam generation system is deactivated by closing the air valve entirely. No balancing of pressures between the inlet solution water pressure and inlet air pressure is required in order to produce high-quality foam with the preferred embodiment of the present invention; the inventor believes that the novel design of the mixing chamber provides adequate mixing at exit chamber 12 even across a wide range of inlet solution water and air pressures.

While the preferred embodiment has been described with reference to OAFS firefighting equipment, it may be understood by those skilled in the art that the invention is not so limited. The invention finds application wherever it is desirable to produce a thorough mixture of a gas and one or more liquids.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claim.

In general the terms and phrases used herein have their art-recognized meaning, which can be found by reference to standard texts, journal references and contexts known to those skilled in the art. The preceding definitions are provided to clarify their specific use in the context of the invention. All references cited herein are hereby incorporated by reference to the extent that there is no inconsistency with the disclosure of this specification.

All patents and publications mentioned in the specification are indicative of the levels of skill of those skilled in the art to which the invention pertains. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention.

The invention claimed is:

1. A foam generating apparatus, comprising:

a. an entry chamber comprising a first entry chamber diameter and a second entry chamber diameter, wherein the second entry chamber diameter is wider than the first entry chamber diameter;

b. an exit chamber comprising a first exit chamber diameter and a second exit chamber diameter, wherein the second exit chamber diameter is wider than the first exit chamber diameter;

c. an air manifold separating the entry and exit chamber, comprising:

i. a back air manifold face adjacent the second entry chamber diameter;

ii. a front air manifold face adjacent to the second exit chamber diameter, wherein the front and back air manifold faces connect to form a hollow air chamber therebetween enclosed at a periphery of the air manifold;

iii. an air inlet connected to the hollow air chamber;

iv. a plurality of liquid passages passing through the front and back air manifold faces whereby liquid may pass from the entry chamber into the exit chamber without entering the air manifold, to result in a plurality of liquid streams in the exit chamber; and v. a plurality of air apertures positioned around and between the plurality of liquid passages to inject air around and between the plurality of liquid passages;

d. a source of pressurized liquid connected to the entry chamber;

e. a liquid valve positioned to control a flow of liquid from the source of pressurized liquid into the entry chamber;

f. a source of pressurized gas connected to the air inlet; and g. an air valve positioned to control a flow of gas from the source of pressurized gas to the air inlet.

2. The foam generating apparatus of claim 1, wherein the air manifold comprises a diameter equal to the second exit chamber diameter.

3. The foam generating apparatus of claim 1, wherein at least one of the plurality of air apertures comprises a diameter smaller than a diameter of at least one of the plurality of liquid passages through the air manifold.

4. The foam generating apparatus of claim 3, wherein at least one of the air apertures is aligned to eject air into the exit chamber in a direction perpendicular to a plane formed by the front face of the air manifold.

5. The foam generating apparatus of claim 4, wherein at least one of the liquid passages is aligned to pass liquid into the exit chamber in a direction perpendicular to the plane formed by the front face of the air manifold.

6. The foam generating apparatus of claim 5, wherein each of the plurality of air apertures is aligned to eject air into the exit chamber in a direction parallel to the direction in which each of the plurality of liquid passages is aligned to pass liquid from the entry chamber into the exit chamber.

7. The foam generating apparatus of claim 5, wherein each of the air apertures is positioned on the front face of the air manifold adjacent to at least two of the liquid passages.

8. The foam generating apparatus of claim 5, wherein each of the liquid passages is positioned on the front face of the air manifold adjacent to at least two of the air apertures.

* * * * *